United States Patent [19]

Gabriels

[11] 4,013,011

[45] Mar. 22, 1977

[54] THROWING DEVICE FOR GRENADES

[75] Inventor: Andre Gabriels, Genk, Belgium

[73] Assignee: Fabrique Nationale Herstal S.A., Herstal-lez-Liege, Belgium

[22] Filed: Aug. 27, 1975

[21] Appl. No.: 608,396

[30] Foreign Application Priority Data

Apr. 8, 1975 Belgium ..... 54254

[52] U.S. Cl. ..... 102/65.2

[51] Int. Cl.[2] ..... F42B 11/42

[58] Field of Search ..... 42/1 F; 102/65.2

[56] References Cited

UNITED STATES PATENTS

| | | | |
|---|---|---|---|
| 3,491,693 | 1/1970 | Streckfuss et al. | 102/65.2 |
| 3,620,162 | 11/1971 | King | 42/1 F |
| 3,726,036 | 4/1973 | Jennings et al. | 42/1 F |
| 3,934,513 | 1/1976 | Gabriels | 102/65.2 |

FOREIGN PATENTS OR APPLICATIONS

| | | | |
|---|---|---|---|
| 591,485 | 4/1959 | Italy | 42/1 F |
| 605,919 | 6/1960 | Italy | 42/1 F |

*Primary Examiner*—Charles T. Jordan
*Attorney, Agent, or Firm*—Bacon & Thomas

[57] ABSTRACT

Throwing device for grenades by means of a weapon such as a rifle, a tubular casing extending the rear portion of the grenade, said device comprising a bullet trap housed within, wherein said bullet trap comprises two main parts, namely a hard mass under the form of a truncated revolution body and a bearing disc adjoining the large base of the said mass.

8 Claims, 5 Drawing Figures

THROWING DEVICE FOR GRENADES

The U.S. patent application Ser. No. 480,170, now U.S. Pat. No. 3,934,513 discloses a throwing device for a grenade or a similar projectile by means of a weapon such as a rifle, of the type comprising a tubular casing extending the rear portion of the grenade, a bullet trap being housed within the said tube. Said device is particularly characterized in that the said bullet trap comprises a steel mass undercalibrated relative to the said tube and provided, near each of its ends, with one or several centering projections bearing on the inner wall of the said tube or on a corresponding portion of the grenade body. An auxiliary charge is provided in the said tube about at least a portion of the said steel mass forming the bullet trap. In addition, the latter is provided with risers or passages allowing the gas flow from the rear portion to the front portion of the said auxiliary charge. Said main patent has also described various characteristics and modifications relative to constituting elements of the throwing device.

The present invention relates to improvements to such type of throwing device in order to modify some constituting portions thereof, while promoting practically and economically the assembling and mounting operation without any detrimental effect to the good efficiency of the throwing device. Another object of the present improvements is to condition said device so that it may be suitable for any type of ammunition such as a cartridge with a bullet or with a lead or steel core, tracer bullets, propellant cartridges and similar.

Still another object of this invention is to condition the throwing device so that the auxiliary charge may be introduced in bulk, previously packaged, compressed or under any suitable form or state. Still another object of the present improvements is to proceed so that the bullet trap does not mandatorily consist of a steel mass, it being understood that use may be made of other materials or hard materials.

There are still provided other characteristics which will be more apparent from the following detailed description of a non limitative embodiment, reference being made to the enclosed drawings in which.

Figure 1:
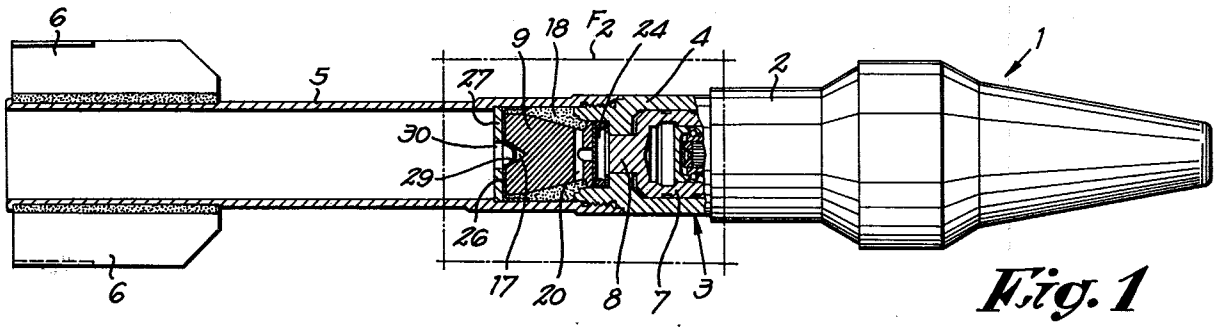
FIG. 1 shows a diagrammatic partial axial section of a grenade equipped with the improved device according to the present Patent Application.
Figure 2:
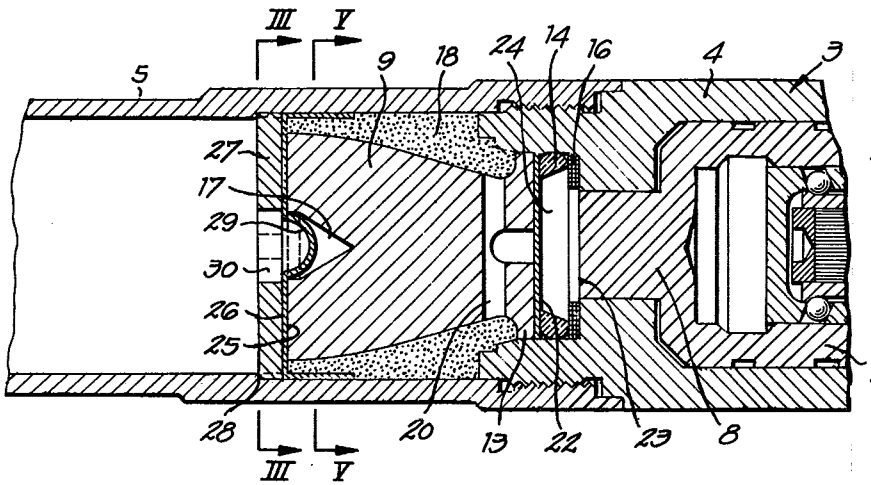
FIG. 2 shows a view of the portion indicated at F2 in FIG. 1 on an enlarged scale.

The embodiment shown on FIG. 1 comprises the grenade 1 the body 2 of which is extended at its rear portion of a rocket 3 the body 4 of which is itself extended by a tubular casing 5 namely provided with four stabilizing blades 6. The rocket 3 comprises an axially moving lock 7 the back portion 8 of which engages with an easy fit the axial passage of the rocket 3 so that the rear base 23 thereof is disposed in the plane of the bottom of the chamber 24. According to a main characteristic of the present improvements, the bullet trap comprises two essential parts, namely a hard mass, e.g. but not necessarily a steel mass 9 and a bearing disc 27, e.g. of aluminium or a light alloy. The large base 25 of the said hard mass is directed to the rear portion of the tubular casing 5. Between the said mass 9 and the said bearing disc 27, may be interposed a thin wall, e.g. under the form of a cup 26 preferably made of a relatively hard and flammable material, e.g. celluloid. The said disc 27 is substantially rigid and bears on a shoulder 28 which provides abutment means formed on the portion adjoining the inner wall of the tubular casing 5. According to another characteristic of the present improvements, the mass 9 is advantageously under the form of a revolution body the large base of which may be provided with a conically shaped central blind hole 17 in a preferred embodiment, the central curved portion 29 of the said sealing cup 26 having the possibility to engage the said blind hole. In the case it is adapted, the said conical hole 17 may have an inlet with a varying diameter, e.g. a diameter slightly higher than that of the propelling bullet.

Figure 3:
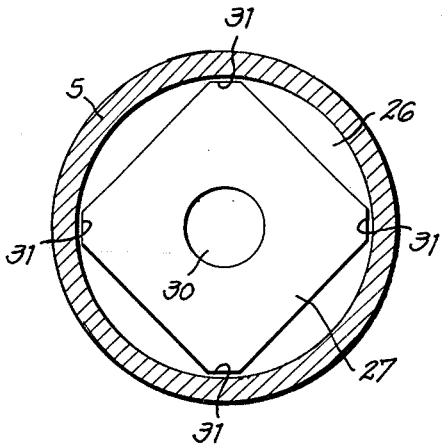
FIG. 3 shows a section on the line III—III of FIG. 2.
Figure 4:
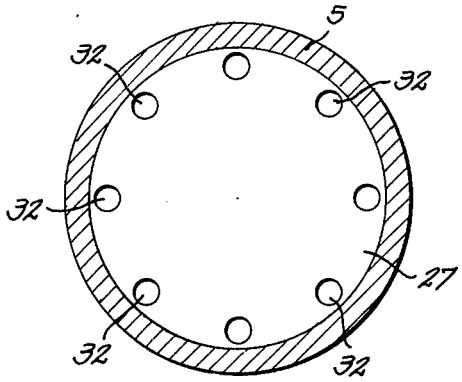
FIG. 4 shows a modification of FIG. 3.
Figure 5:
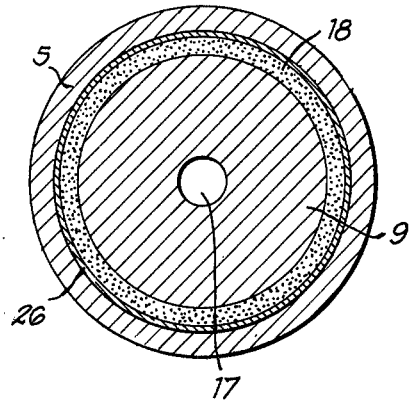
FIG. 5 shows a section on the line V—V of FIG. 2.

From the above, it results that one of the main characteristics of the present improvements is that, contrarily to the U.S. Pat. No. 3,934,513, the bullet trap is herein made of two main parts, thereby simplifying the manufacture since the hard mass under the form of a revolution solid does not need any milling operation. At the level of its small base, the bullet trap 9 has an annular projection 13 engaging the said chamber 24 where it is covered with an obturating disc 22. A washer 14 is disposed between a felt washer 16 and the said obturating disc 22. Said washer 14 forms a damping device. It has an annular or truncated shape or other. The auxiliary charge 18 is provided in the space defined by the outer wall of the mass 9 and the adjoining portions of the rocket body 4, the tubular casing 5 and the cup 26 respectively. The said bearing disc 27 is namely, but optionally provided with a central hole 30. It may be variably outlined in order to form passages to the said axuiliary charge 18. Said bearing disc could have any geometrical shape, a quadrangular shape with cut corners 31 such as represented in FIG. 3 or still a circular shape could be adopted, in which case the bearing disc would be provided with one or several openings 32 such as those represented in FIG. 4. As regards the risers 20 provided in the U.S. Pat. No. 3,934,513, in some cases, they could be omitted.

These improvements have substantial advantages both economically and as regards the efficiency and the safety for the shooter and the shooting. In fact, according to the above-described improvements, the safety of the shooter is ensured namely by the fact that a breaking of the bullet trap does no more cause the breaking of the tubular casing 5, whereas the general configuration of the device is such that it very substantially alleviates or even prevents the projection of unburned products and molten lead towards the shooter. The safety of the shooting is certainly ensured by the fact that the speed of the grenade remains identical, the bullet or ball trap being broken down or not. Thus, in any event, the target will be reached. It results also that the sealing cup 26, e.g. of celluloid, will be no more in direct contact with the sleeve of the weapon. The vibration resistance is also improved. On the economical point of view, an easier and less expensive mechanization is provided.

What we claim is:

1. A device for firing a grenade or the like from a weapon such as a gun, comprising: a tubular casing affixed to the rear of the grenade; abutment means on the inner wall of said tubular casing; a bullet trap in said tubular casing between said abutment means and said grenade, said bullet trap comprising a hard mass under the form of a truncated revolution body and a substantially rigid metal bearing disc adjoining at one side thereof, the large base of said hard mass, the other side of said bearing disc engaging said abutment means, the small base of said hard mass being supported by a portion of the body of said grenade.

2. Improvements according to claim 1, wherein the mass forming the bullet trap proper is made of steel, the bearing disc being made of aluminium.

3. Improvements according to claim 1 wherein the bearing disc has optionally a central hole and passages therethrough provided adjacent its periphery.

4. Improvements according to claim 1 wherein a thin sealing wall is interposed between the mass forming the bullet trap proper and the bearing disc.

5. Improvements according to claim 4, wherein the said sealing wall with thin walls is made of a relatively hard flammable material such as, e.g. celluloid.

6. Improvements according to claim 3, wherein an auxiliary charge surrounds the main portion of the hard mass and the said bearing disc has such a configuration that it provides passages between the tubular casing, on one hand, and the auxiliary charge surrounding the bullet trap, on the other hand.

7. Improvements according to claim 3, wherein the said bearing disc has a configuration similar to that of the adjoining portion of the inner wall of the tubular casing, said disc being traversed by openings in any relative shape, number and disposition.

8. Improvements according to claim 4 wherein the large base of the hard mass is provided with a centrally located blind hole and the sealing wall is curved at its central portion and the curved portion is engaged in said blind hole.

* * * * *

UNITED STATES PATENT OFFICE

CERTIFICATE OF CORRECTION

PATENT NO. : 4,013,011

DATED : March 22, 1977

INVENTOR(S) : ANDRE J. C. GABRIELS

It is certified that error appears in the above-identified patent and that said Letters Patent are hereby corrected as shown below:

The name of the Assignee should read:

"Fabrique Nationale Herstal S.A. en abrege FN".

The number of the Belgium priority document should read:

"2/54254".

Signed and Sealed this

First Day of November 1977

[SEAL]

*Attest:*

RUTH C. MASON
*Attesting Officer*

LUTRELLE F. PARKER
*Acting Commissioner of Patents and Trademarks*